US006846999B2

(12) United States Patent
Kawakami et al.

(10) Patent No.: US 6,846,999 B2
(45) Date of Patent: Jan. 25, 2005

(54) SWITCH BUTTON AND RECORDING APPARATUS

(75) Inventors: Kazuhisa Kawakami, Kanagawa-ken (JP); Yasushi Koike, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/610,585

(22) Filed: Jul. 2, 2003

(65) Prior Publication Data

US 2004/0074756 A1 Apr. 22, 2004

(30) Foreign Application Priority Data

Jul. 4, 2002 (JP) ..... 2002-195806

(51) Int. Cl.[7] ..... H01H 13/14
(52) U.S. Cl. ..... 200/341; 200/345
(58) Field of Search ..... 200/5 A, 517, 200/314, 341–345, 490, 491, 491.2, 493, 494, 495, 495.1, 496; 400/490, 491, 491.2, 493, 494, 495, 495.1, 496

(56) References Cited

U.S. PATENT DOCUMENTS 4,613,736 A * 9/1986 Shichijo et al. ..... 200/317
4,716,262 A * 12/1987 Morse ..... 200/5 A
5,642,950 A * 7/1997 Hochgesang et al. ..... 400/490
6,466,747 B2 * 10/2002 Tanaka ..... 396/543
6,710,275 B2 * 3/2004 Sunadome ..... 200/341

* cited by examiner

*Primary Examiner*—Michael A. Friedhofer
(74) *Attorney, Agent, or Firm*—Fitzpatrick, Cella, Harper & Scinto

(57) ABSTRACT

A switch assembly includes a key member pushing the switch and a cap member made of a material not compatible to the key member and covering the key member. The key member and the cap member are formed in a substantially united body, and the key member has a hole passing therethrough from a portion not covered by the cap member to another portion covered by the cap member.

14 Claims, 6 Drawing Sheets

FIG. 6

Suitability of thermoplastic resin[49;67]

| | | additives | | | | | | | | | | | |
|---|---|---|---|---|---|---|---|---|---|---|---|---|---|
| | plastic | PE | PVC | PS | PC | PP | PA | POM | SAN | ABS | PBTP | PETP | PMMA |
| main materials | PE | 1 | 4 | 4 | 4 | 1 | 4 | 4 | 4 | 4 | 4 | 4 | 4 |
| | PVC | 4 | 1 | 4 | 4 | 4 | 4 | 4 | 1 | 2 | 4 | 4 | 1 |
| | PS | 4 | 4 | 1 | 4 | 4 | 4 | 4 | 4 | 4 | 4 | 4 | 4 |
| | PC | 4 | 3 | 4 | 1 | 4 | 4 | 4 | 1 | 1 | 1 | 1 | 1 |
| | PP | 3 | 4 | 4 | 4 | 1 | 4 | 4 | 4 | 4 | 4 | 4 | 4 |
| | PA | 4 | 4 | 3 | 4 | 4 | 1 | 4 | 4 | 4 | 3 | 3 | 4 |
| | POM | 4 | 4 | 4 | 4 | 4 | 4 | 1 | 4 | 4 | 3 | 4 | 4 |
| | SAN | 4 | 1 | 4 | 1 | 4 | 4 | 4 | 1 | 1 | 4 | 4 | 1 |
| | ABS | 4 | 2 | 4 | 1 | 4 | 4 | 3 | 4 | 1 | 3 | 3 | 1 |
| | PBTP | 4 | 4 | 4 | 1 | 4 | 3 | 4 | 4 | 3 | 1 | 4 | 4 |
| | PETP | 4 | 4 | 3 | 1 | 4 | 3 | 4 | 4 | 3 | 4 | 1 | 4 |
| | PMMA | 4 | 1 | 3 | 1 | 4 | 4 | 3 | 1 | 1 | 4 | 4 | 1 |

1 : suitable

2 : suitable with limitation

3 : suitable if small quantity is added

4 : unsuitable

SWITCH BUTTON AND RECORDING APPARATUS

BACKGROUND OF THE INVENTION

1. Field of the Invention

This invention is related to a switch button to press an electric switch and the recording apparatus having the switch button.

2. Description of Related Background Art

Electric, electronic apparatuses including home electronic products recently come to have the similar goods specifications in respective sales price bands among competitive entities, and industrial designs tend to provide distinguishable property. As elements for distinguishable property, shape of appearance, color, and qualitative feeling found in material are exemplified.

Products having metallic taste industrial designs are increasing their number recently among goods particularly having portability such as cameras and cellar phone devices as well as electric, electronic apparatuses in the field of personal computers. To obtain those metallic taste industrial designs, some parts can be found using, as a material, metal itself, resin with a metallic taste coating, so called metallic resin containing a metal powder, and the like.

In the meantime, recycling and reuse trends in resins of petroleum chemical products, other than metal materials that have been recycled, are raising these days concurrently with raising of environment protection minds. In consideration of only the territory of Japan, enacted is a law relating to processing and cleaning of wastes (Showa45 law No. 137, generally referred to as "waste processing law"), a law relating to promotion of use of recycled resources (Heisei 3 law No. 48, generally referred to as "recycle law"), a law relating to separate collection about container packages and promotion of re-commercialization, etc. (Heisei 7 law No. 112, generally referred to as "package recycle law"), specific home use apparatus re-commercialization law (Heisei 10 law No. 97, generally referred to as "home electronics recycle law"), etc. According to establishments of those legal restrictions, recycling of thermoplastic resin is accelerated among some goods for large size homes, electronics goods and automobiles.

Reduction of integral formation among parts made of materials having property not mutually soluble to each other and reduction of the material number itself are targeted in environmental regulations or the like in respective countries, and coating on a resin and printing area size are also exemplified as targets of regulations.

Though there is Germany "Blue Angel" as a representative environmental regulation, "Eco Mark" certifications are given in Japan in respective categories from the Japanese Environment Association. "Eco Marks" are set, regarding office apparatus products, for personal computers and photocopiers on November, 1999, and for printers on October, 2001. There are descriptions "checking on suitability with respect to materials" or "satisfying VD12243," and those are matters requiring compatibility among materials.

The compatibility refers to a mutually soluble state in a case that, e.g., polymers of two or more kinds are mixed. That is, the compatibility means a nature that two or more kinds of materials having affinity mutually become a solution or a mixture. Simple mixture is no more than dispersion of materials and distinguishable from the compatibility because of lack of solution.

FIG. 6 is a figure showing the solubility among resin materials, and is published in VDI2243 (Verien Deutscher Ingenieure: the October, 1993 version ). For example, it is described that the resin having solubility is ABS plastic, PC resin (Polycarbonate RESIN), and PMMA resin (Polymethyl Methacrylate RESIN) in a case that, they are mixed with ABS resin (Acrylonitrile_Butadiene_Styrene RESIN).

For example, in a case that a key setting up the function of a power or an apparatus is considered to be added with, e.g., color and quantitative feeling found in material for a distinguishing purpose, the environment standards and the environment regulations are to be considered though some choices can be thought.

In a case that the key is structured of a metal only, it is necessary to fully consider electric safety because the metal is operated to a switch mounted on a control substrate. Moreover, the formed shape is subject to considerable restrictions in metal processing, and the position of the switch and the method of fixing the key are subject to considerable restrictions.

On the other hand, in a case that the key is structured of a resin only, the resin is conventionally painted to correspond the needs to obtain a distinguishable industrial design. With such a conventional painting, e.g., metallic quantitative feeling is not expressed with painting, so that the key may be finished with a mediocre industrial design. Moreover, even if desired color is acquired, in the reproduction process of resin, there are the following fault points. (1) A resin portion will also be shaved off in order to remove all paints. (2) Paint of the curved surface section and the hollow section cannot be removed unless the painted resin members are destroyed.

The reproduction process is taken into consideration, the paint having compatibility to a resin is suitable. But the environment is taken into consideration, paint having solubility is not enough since solvent is used in order to melt pigment in paint.

SUMMARY OF THE INVENTION

A representative structure according to the invention to accomplish the above objects is a switch selecting conduct or insulation at a point of electrical contact comprising: a key member pushing the switch; and a cap member made of a material not soluble to the key member and covering the key member, wherein the key member is covered by the cap member, and the key member and the cap member are formed in a united body substantially, and wherein a separate hole for separating the cap member is opened in the key member.

As described above, according to the invention, a switch button satisfies excellent in the industrial design, function and operation, and it is easy to separate the switch key made of two material not to be compatible to each other, so that the invention can respond to the environment standards

BRIEF DESCRIPTION OF THE DRAWINGS

FIG. 6 is a chart of VDI2243 showing the compatibility among resin materials.

DETAILED DESCRIPTION OF THE PREFERRED EMBODIMENTS

Figure 1:
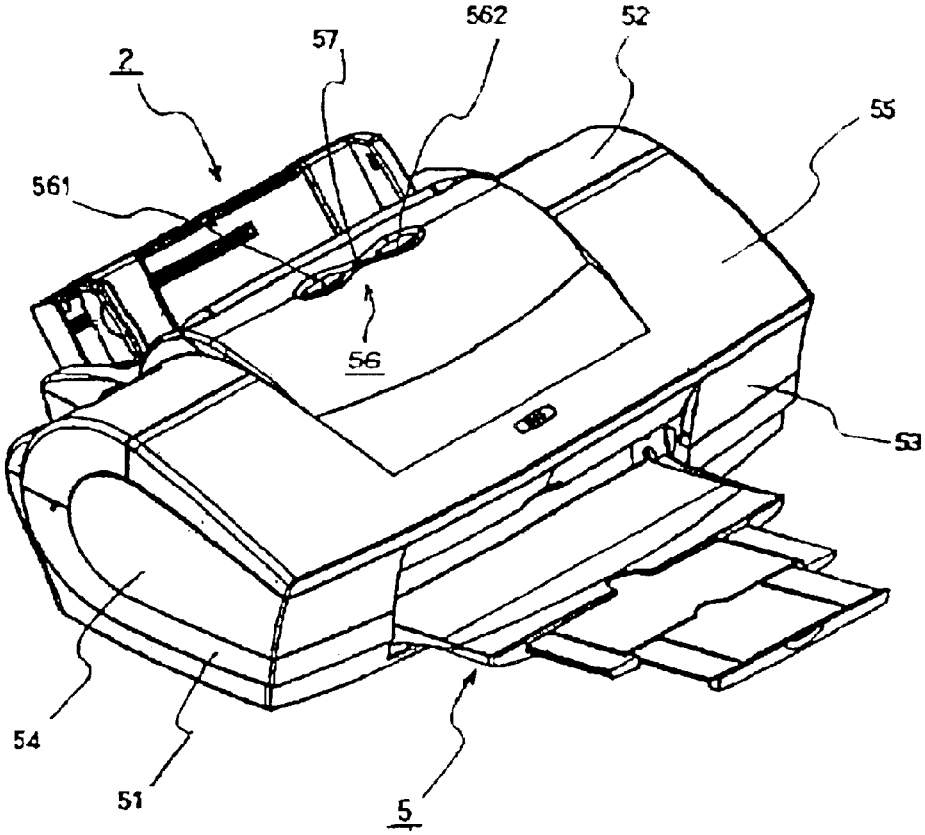
FIG. 1 is a perspective view showing the entire structure of an inkjet recording apparatus in the first embodiment.

Hereinafter, referring to the drawings, preferred embodiments of the invention are described in detail in an exemplifying manner. The sizes, materials, shapes, and correlative positions of structural parts as set forth in the embodiments below can be modified properly according to the apparatus structure to which this invention applies and to various conditions and terms, and if there is no special description, the scope of this invention is not intended to be limited only to those.

FIRST EMBODIMENT

Figure 2:
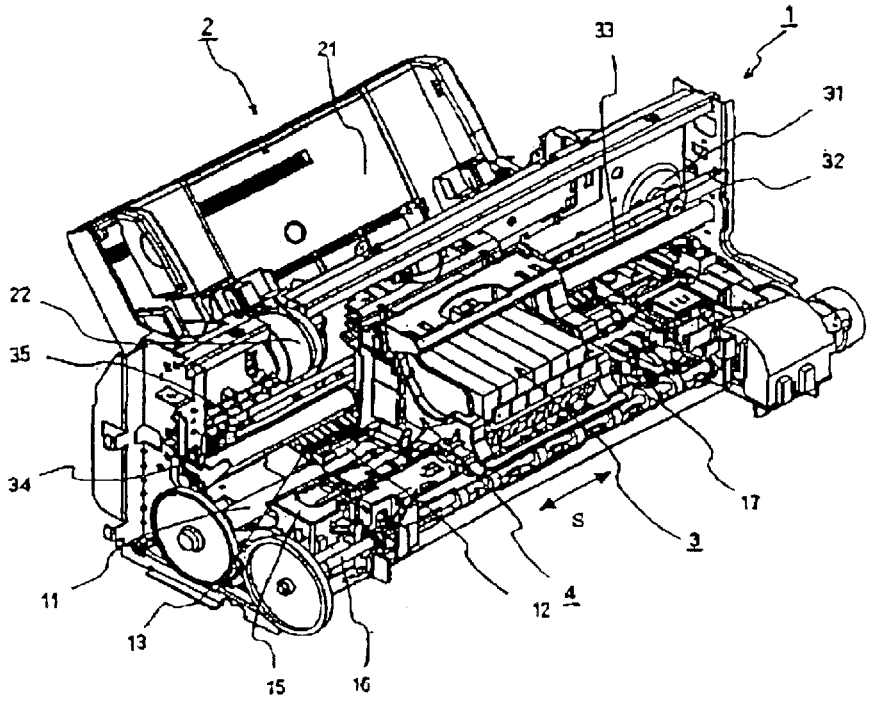
FIG. 2 is a perspective view of the mechanism in FIG. 1.

Hereinafter, the first embodiment of the invention is described with reference to the drawings. FIG. 1 is a perspective view showing the entire structure of an inkjet recording apparatus in the first embodiment in the invention; FIG. 2 is a perspective view of mechanism in FIG. 1.

As shown in FIG. 1 and FIG. 2, recording sheets layered on a pressure plate 21 of the ASF unit 2 is urged to the feeding roller 22 by pushing force of a spring, not shown, and is separated and fed one by one with the feeding roller 22 which rotates by a feeding command.

The pinch roller 12 held at the roller holder 13 is urged to the conveyance roller 11 by a spring, not shown. The pinch roller 12 gives conveyance force by pressuring a recording sheet on the conveyance roller 11. The conveyance roller 11 is driven by a conveyance motor, not shown, and conveys a recording sheet by the conveyance force generated by pressuring force of a pinch roller 12, and regulates the position of the recording field of the recording sheet to a recording head 4.

Platen 15 is formed over the total range of the direction of arrow S where a recording head 4 moves and outlets of a recording head 4 counters. The platen 15 regulates the position of a recording sheet so that the space of a recording head 4 and the recording field of a recording sheet can be kept constant.

In this embodiment, conveyance of the recording sheet is performed intermittently for every scan of a recording head 4, and the amount of conveyances correspond to the length of a line of ink outlets established in a recording head 4 in the conveyance direction of the recording sheet. The conveyance speed of the conveyance roller 11 is set up equally to the conveyance speed of the feeding roller 22.

A delivery roller 16 is disposed as facing to each other and is formed on a downstream side of the recording head 4, and a spur 17 is disposed corresponding to the delivery roller 16, and a recording sheet is recorded by the conveyance of the recording sheet performed for every scan of a recording head 4 and discharging ink through the recording head 4, and is delivered by a delivery roller 16, and is stacked on a delivery tray unit 5.

The recording head 4 serving as a recording means is mounted on the carriage unit 3, and scans in the direction of arrow S. The drive force is transmitted via a driving pulley 32 and a belt 33 attached in the carriage motor 31 from a carriage motor 31 as a drive source to the carriage unit 3. The belt 33 is suspended by a driving pulley 32 and a driven pulley 34, and is structured to transmit the drive force of the carriage motor 31 to the carriage unit 3 exactly by application of a certain tension force of a spring 35.

The recording head as a recording means is for recording an ink image on the recording sheet. As a recording means for this apparatus, an inkjet recording method is used in which ink is discharged from the recording head. That is, the recording head includes fine fluid outlets (orifices), fluid routes, energy operation portions formed at a portion of the fluid routes, and energy generating means for generating droplet formation energy operating the fluid located at the energy operation portion.

As an energy generating means for generating such energy, employed are a recording method using an electromechanical converter such as a piezo device or the like, a recording method using an energy generating means generating heat upon radiation of electromagnetic wave of laser or the like, and a recording method using an energy generating means discharging fluid in heating the fluid with an electrothermal converter such as a heat generating device having a heating resister.

The recording head used for an inkjet recording method of discharging the fluid with thermal energy, inter alia, can make recording with high definition because the fluid outlet (orifices) for forming droplets to be discharged by discharging droplets for recording can be arranged in a high density. The recording head using the electro-thermal converter as the energy generating means, inter alia, is easily made compact and is advantageous because the head can be mounted with a high density and be produced with less costs.

In this embodiment, as a discharge structure for ink, it is structured to make recording by energizing the electrothermal converter in response to a recording signal, and discharging ink through the orifices upon growth and contraction of bubbles generated in the ink in utilizing the film boiling generated in the ink from the thermal energy.

The explained recording apparatus 1 is covered with a lower casing 51, an upper casing 52, a forward right cover 53, a forward left cover 54, and an access cover 55 as housing members forming the apparatus housing. The access cover 55 is formed in the upper casing 52 so as to be opened and closed, and the ink tank becomes replaceable, as well as paper jamming can be recovered, upon opening the access cover 55. An operation Key 56 is a switch button is formed in a united body as described below by resin molding of a power key 561 and a reset key 562. An online lamp 57 indicates a recordable status of an inkjet recording apparatus upon turning on.

Figure 3:
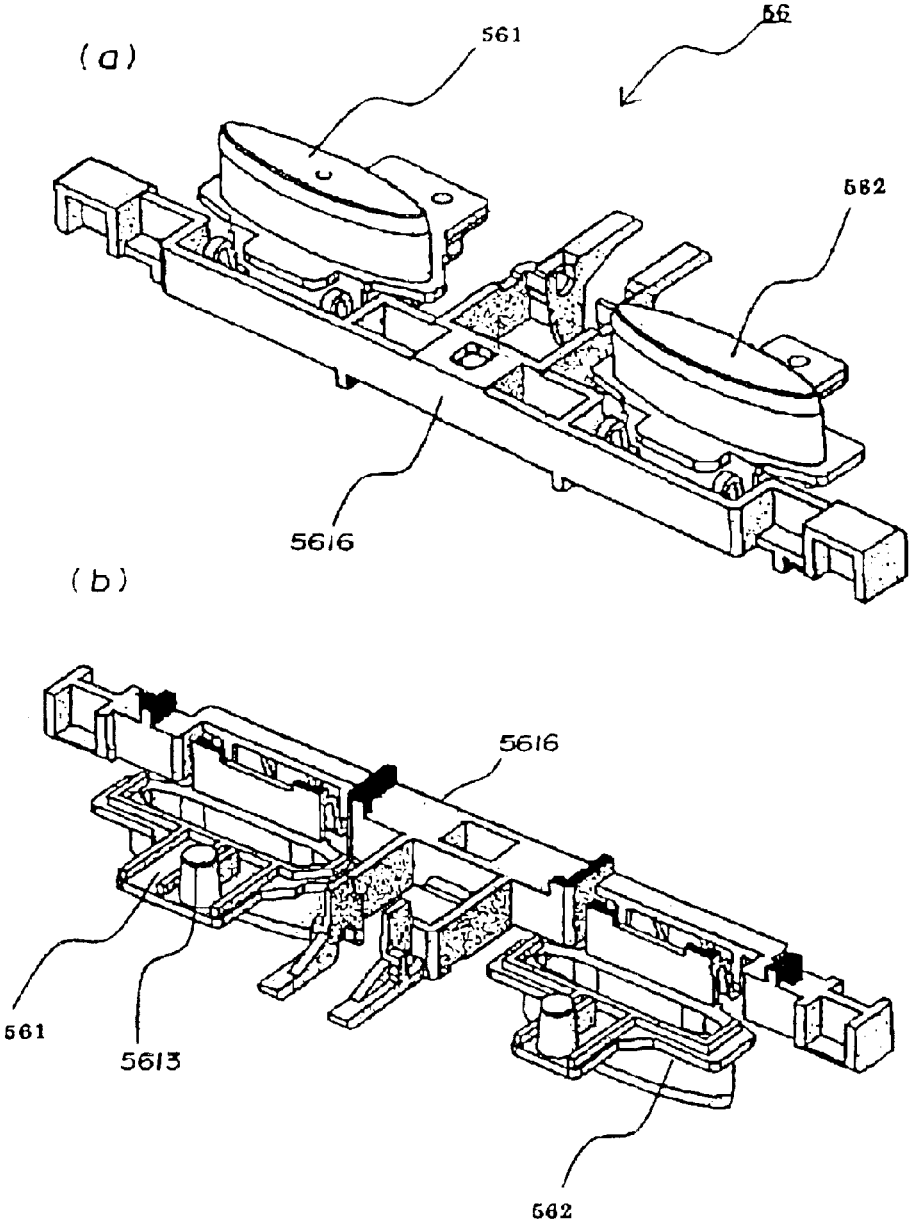
FIG. 3 is a front perspective view(a) and a back perspective view(b) showing details of the operating key in FIG. 1.
Figure 4:
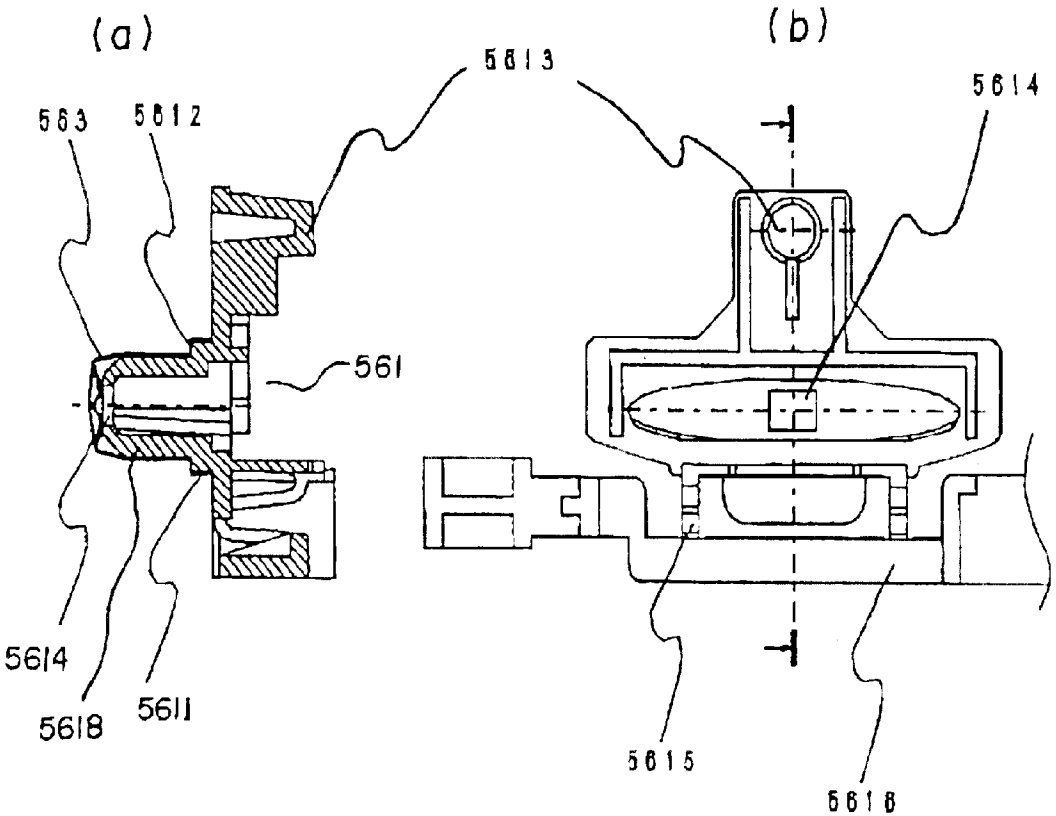
FIG. 4 is a cross section view (a) and a back surface view (b) illustrating details of the power key in FIG. 1.
Figure 5:
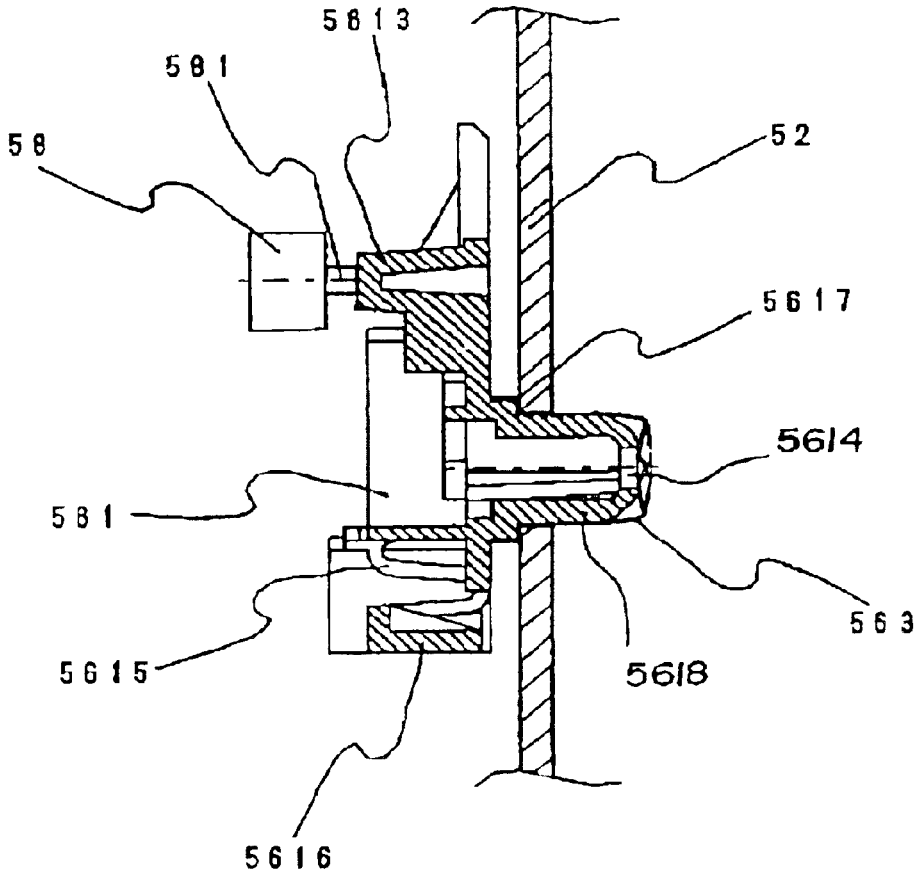
FIG. 5 is a cross section view illustrating a position relation of a power key, an upper casing, and a power switch.

Next, referring to FIG. 3 to FIG. 5, a structure of the operation key is described in detail. FIG. 3 is a front perspective view(a) and a back perspective view(b) showing details of the operating key in FIG. 1; FIG. 4 is a cross section view (a) and a back surface view (b) illustrating details of the power key in FIG. 1; FIG. 5 is a cross section view illustrating a position relation of a power key, an upper casing, and a power switch.

The operation key 56 as the switch button pushes a switch (a power switch 58) selecting conduct or insulation at a point of electrical contact. The operation key 56 is formed in a united body by the power key 561, the reset key 562, and a cap 563. The power key 561 and the reset key 562 is a key member pushing the switch (the power switch 58). The cap 563 as a cap member covering the power key 561 and the reset key 562 is made from materials not compatible to each other.

Furthermore, the cap 563 is made from not only materials not compatible to the key 561, 562 but also materials suitable for ornament.

More specifically, in this embodiment, the power key 561, the reset key 562 as key members are molded by thermoplastic PC+ABS alloy plastic. And the cap 563 as a cap members is made of the metal (aluminum) not compatible to the key 561, 562. And the power key 561, the reset key 562, and a cap 563 are formed substantially in a united body.

Thus, the cap 563 as a cap member needing good appearance is made of the metal, and the key 561,562 as key members having a form which moves as a hinge and should not be restricted is molded by thermoplastic resin. With this structure, the operation key 56 can be more freely designed.

As shown in FIG. 3, the power key 561 of ink-jet recording apparatus, and the reset key 562 stopping error processing and a job during printing is formed via frame 5616 in a united body. Furthermore, because the power key 561 and the reset key 562 are the same form and composition for the same function. Herein, the power key 561 is described in detail.

As shown in FIG. 4 and FIG. 5, 1st pressure portion 5618 pressured by the user is covered with the cap 563, and the cap 563 is fixed on a fitting portion 5611 of the power key 561 in the circumference direction. The position of the cap 563 to the power key 561 in the mounting direction is settled by a cap positioning portion 5612 of the power key 561.

The cap 563 is made of the metal, and in this embodiment, is made of the aluminum board having a thickness of 0.15. As shown in FIG. 5, the cap 563 projects from the upper casing 52 as housing members forming the apparatus housing. Because it is to be noted that the cap 563 is made of a metal (the aluminum in this embodiment), the cap 563 can obtain the high-class feeling as a design by texture of the metal. Moreover, because the user manipulates the key, the key tends to serve as a trigger of electric discharge of the static electrically which a charge user has. But an electric discharge course can be secured, and an electricity failure can be tend not to be caused, because it is to be noted that the cap 563 covering the power key 561 is made of the metal. Moreover, when characters and illustrations are stamped or printed on the surface of the cap 563, durability of metal is higher than resin.

The cap 563 is made of not only aluminum but also processed steel sheet on which is carried out a surface treatment, printing, painting, etc. However, if the ductility and process ability of material are taken into consideration, aluminum is suited for the material of the cap 563 in the metal. In addition, as a material for improving design, there is thermoplastic resin into which aluminum power and coated glass powder are mixed. This thermoplastic resin can change the design by reflection of light.

On the other hand, the power key 561 is molded by injecting plastic (thermoplastic plastic, PC+ABS alloy plastic in this embodiment) having high incombustibility, because the power key 561 is formed by, e.g., a hinge 5615 as described below in a united body, and because the power switch 58 (see, FIG. 5) is directly pressured on a control substrate, not shown.

As described, the power key 561 as a key member is molded by thermoplastic resin, and the cap 563 as a cap member is made of a metal, and the operation key 56 formed in a united body by the power key 561 and the cap 563 is made of a material having no solubility as described, so that it is necessary to separate the operation key 56 when apparatus is discarded or recycled. The separate hole 5614 for separating cap 563 from the power key 561 is opened in 1st pressure portion 5618 of the power key 561. Accordingly, the cap 563 can easily be separated from the power key 561 by inserting a cylindrical thing having a thin distal end, such as a driver in the separate hole 5614. Furthermore, in this embodiment, the separate hole 5614 is a rectangle 3×4 [mm].

The power switch 58 as a switch selecting conduct or insulation at a point of electrical contact is mounted on the control substrate, not shown. The power switch 58: in this embodiment is a so called tactile switch, and has a form which completed the switch function with the single article. A switch pressure portion 5613 as the 2nd pressure portion of the power key 561 is contacting with the tactile portion 581 of a power switch 58. The power key 561 is attached to the frame 5616 via the hinge 5615 so that it is driven to move by the reaction force of a power switch 58 and the control force pressing the switch.

Moreover, as shown in FIG. 5, the power key 561 as a key member is urged to the upper casing 52 as housing members forming the apparatus housing by the reaction force of a power switch 58, and the position of the power key 561 to the upper casing 52 by a case positioning portion 5617. Because the case positioning portion 5617 and the cap positioning portion 5612 are in the front reverse side of the cap 563, a tolerance of the portion of the power key 561 to the upper casing 52 can be controlled to a minimum.

As described, according to this embodiment, a switch button (the operation key 56) excellent the industrial design when the apparatus is used can be produced. Moreover, a switch button (the operation key 56) excellent in function and operation as a key can be produced. Furthermore, it is easy to separate the operation key 56 made of two materials (the power key 561 or the reset key 562 and the cap 563.

Other Embodiments

Although in the embodiments described above, the structure that the power key 561 presses the power switch 58 directly, is exemplified, this invention is not limited to this. For example, a part such as a link bar may be formed between the power key 561 and the power switch 58, the power key 561 may press the power switch 58 via the part.

Although in the embodiments described above, the operation key 56 formed in a united body by the power key 561 and the cap 563, is exemplified, this invention is not limited to this. For example, arbitrary numbers of keys can be set as requirements for a design and can be set according to the necessity.

Although in the embodiments described above, the separate hole 5614 as a rectangle 3×4[mm], is exemplified, this invention is not limited to this. If it is the size to penetrate a tool which can generally be purchased such as a screwdriver, there will be no restriction in the form and the size of the separate hole.

In the embodiments described above, the number and the kind of the recording heads are not exemplified specifically, but this invention is applicable to, notwithstanding of the number and the kind of the recording heads, such as an inkjet recording apparatus using a single recording head, an inkjet recording apparatus for color recording using a plurality of recording heads making recording with inks in different colors, and an inkjet recording apparatus for grayscale recording using a plurality of recording heads recording with inks having different density of the same color, and the advantages described above can be achieved.

As a recording means (recording head), this invention is applicable to any structure of the recording means and ink tank, such as a cartridge type in which the recording head and the ink tank are formed in a united body, and a structure in which the recording head and the ink tank are formed as separated bodies which are coupled with an ink supplying tube, in substantially the same way, and substantially the same advantages can be obtained.

It is to be noted that in a case that this invention applies to the inkjet recording apparatus, for example, this invention is applicable to an apparatus using a recording means using an electromechanical converter or the like such as a piezo device, and an excellent advantage can be found in, inter alia, an inkjet recording apparatus using the recording means in which ink is discharged by utilizing the thermal energy. With this method, recording can be performed with higher density and higher definition.

Furthermore, this invention is effectively applicable to a recording head of a full line type having a length corresponding to the maximum width of the recording media that the recording apparatus can make recording. As such a recording head, exemplified are a structure satisfying that length by a combination of the plural recording heads, and a structure that a single recording head formed as a united body. In addition, this invention is advantageous, even of a serial type as described above, for such as a recording head secured to the apparatus body, a recording head of a replaceable chip type that allows electrical connections to the apparatus body and ink supply from the apparatus body upon mounting on the apparatus body, and a recording head of a cartridge type in which the ink tank is formed in a united body with the recoding head itself.

As a feature of the inkjet recording apparatus described above, the apparatus can be, other than used as an image output terminal apparatus for information processing apparatuses such as computers, an inkjet input output apparatus capable of mounting a scanner or the like other than the recording head on the carriage, a photocopier in combination with a reader or the like, and a facsimile machine having a transmitting and receiving function.

In the embodiments described above, the inkjet recording method is exemplified as a recording method, but this invention is not limited to this. This invention can apply even to any recording method such as thermal transfer recording methods, thermal sensing recording methods, impact recording methods such as a wire dot recording method, and other electro photographic methods.

What is claimed is:

1. A switch assembly comprising:

a key member pushing the switch; and a cap member for covering the key member, wherein the key member and the cap member are formed in a substantially united body, and wherein the key member has a hole passing therethrough from a portion not covered by the cap member to another portion covered by the cap member.

2. The switch assembly according to claim 1, wherein the key member includes a first pressure portion in which the separate hole is opened and a second pressure portion pressuring the switch, and wherein when the first pressure portion is pressured, the cap member covers the first portion.

3. The switch assembly according to claim 2, wherein the cap member is accessible through the hole from the second portion by a tool.

4. The switch assembly according to claim 1, wherein the key member includes a positioning portion for positioning the key member to a housing member forming an apparatus housing.

5. The switch assembly according to claim 1, wherein the cap member is made of a material suitable for ornament.

6. The switch assembly according to claim 1, wherein a material of the key member is a thermoplastic resin, and a material of the cap member is a metal.

7. A recording apparatus includes recording means for making a recording on a recording medium to be conveyed by discharging ink in response to a signal, wherein, an operation key includes the switch assembly as set forth in any of claim 1 to claim 6.

8. The recording apparatus according to claim 7, wherein the recording means includes an electro-thermal converter generating thermal energy for ink discharge.

9. The switch assembly according to claim 1, wherein the cap member is made of a material which is insoluble to the key member.

10. A switch assembly comprising:

a key member to push a switch; and a cap member made of a material different from material of the key member for covering the key member, wherein the key member and the cap member are formed in a substantially united body, and wherein the key member has a hole passing therethrough from a portion not covered by the cap member to another portion covered by the cap member.

11. The switch assembly according to claim 10, wherein the key member includes a first portion in which the hole is opened and second portion pressuring the switch when the first portion is pressured, wherein the cap member covers the first portion.

12. A recording apparatus includes recording means for making a recording on a recording medium to be conveyed by discharging ink in response to a signal, wherein, an operation key includes the switch assembly as set forth in claim 10 or claim 11.

13. The switch assembly according to claim 11, wherein the cap member is accessible through the hole from the second portion by a tool.

14. The switch assembly according to claim 10, wherein the cap member is made of a material which is insoluble to the key member.

* * * * *

UNITED STATES PATENT AND TRADEMARK OFFICE

CERTIFICATE OF CORRECTION

PATENT NO. : 6,846,999 B2
DATED : January 25, 2005
INVENTOR(S) : Kazuhisa Kawakami et al.

It is certified that error appears in the above-identified patent and that said Letters Patent is hereby corrected as shown below:

Column 4,
Line 42, "Key 56 is" should read -- key 56 as --.

Column 5,
Line 26, "0.15." should read -- 0.15 mm. --.
Line 27, "FIG. 5," should read -- FIGS. 1 and 5, --.
Line 36, "be" (first occurrence) should be deleted.

Column 6,
Line 6, "switch 58:" should read -- switch 58 --.
Line 31, "cap 563." should read -- cap 563) made of a material having no compatibility, so that the embodiment can respond to the environment standards. --.

Signed and Sealed this

Twenty-first Day of March, 2006

JON W. DUDAS
*Director of the United States Patent and Trademark Office*